US005901878A

United States Patent [19]

Tyson, III

[11] Patent Number: 5,901,878

[45] Date of Patent: May 11, 1999

[54] BALL CAN VENDING MACHINE

[76] Inventor: T. Grant Tyson, III, Chesapeake, Va.

[21] Appl. No.: 08/800,358

[22] Filed: Feb. 14, 1997

Related U.S. Application Data

[60] Provisional application No. 60/011,794, Feb. 16, 1996.

[51] Int. Cl.[6] ..... G07F 11/44

[52] U.S. Cl. ..... 221/196; 221/205; 221/266; 221/295

[58] Field of Search ..... 221/195, 196, 221/205, 256, 263, 266, 289, 295, 298, 301

[56] References Cited

U.S. PATENT DOCUMENTS

| | | | |
|---|---|---|---|
| 2,834,513 | 5/1958 | Schupp | 221/196 X |
| 3,946,847 | 3/1976 | Bock | 221/200 X |
| 4,054,197 | 10/1977 | Bock | 221/202 X |
| 4,126,217 | 11/1978 | Bock . | |
| 5,009,330 | 4/1991 | Young et al. | 221/196 |
| 5,092,489 | 3/1992 | Pastor et al. | 221/196 X |
| 5,199,598 | 4/1993 | Sampson | 221/194 |
| 5,566,806 | 10/1996 | Reale | 221/129 X |

*Primary Examiner*—F. J. Bartuska
*Attorney, Agent, or Firm*—Fay, Sharpe, Beall, Fagan, Minnich & McKee, LLP

[57] ABSTRACT

A ball can vending machine comprises a cylindrical storage drum including a housing section sized to hold a plurality of ball cans with the longitudinal axes of the cans disposed parallel to the cylindrical axis of the housing section. The housing section includes a forward-facing discharge opening and a rear can-guiding surface, and the storage drum is supported with its disposed horizontally. A retaining plate mounted within the housing section and disposed above the discharge opening slopes downwardly toward the rear can-guiding surface. The vending machine also includes a currency validator that produces an output signal upon receiving a preselected amount of currency. A can dispenser is disposed adjacent the discharge opening such that cans within the housing section are urged by gravity toward the can dispenser along the rear-can-guiding surface. The can dispenser includes a selector arm pivotable between a first position and a second position and an actuator connected to the selector arm and responsive to the currency validator. The actuator pivots the selector arm from the first position to the second position in response to the output signal from the validator. The selector arm includes a dispensing plate adapted to hold a ball can in a nesting relationship when the selector arm is in its first position. Movement of the selector arm from the first position to the second position permits the nested ball can to move under the influence of gravity to the discharge opening.

23 Claims, 9 Drawing Sheets

BALL CAN VENDING MACHINE

This application claims priority from U.S. Provisional Patent Application Ser. No. 60/011,794, filed Feb. 16, 1996.

BACKGROUND OF THE INVENTION

The present invention relates to a machine for dispensing tennis balls and the like. In particular, the invention relates to a currency-operated ball can vending machine.

Tennis is played in a variety of venues, from private country clubs to public courts owned, for example, by municipalities, school boards, and universities. At a private club, the tennis courts typically are served by an adjacent pro shop where players can purchase new tennis balls to replace balls that become worn out or were left in the closet at home. At most public courts, however, there is no nearby tennis ball vendor, so players who arrive without balls cannot play.

There thus is a need for a supply of tennis balls readily available at public tennis courts. This need cannot reasonably be met, however, by establishing a pro shop or sporting goods store at every public court.

The present invention is intended to meet this need by providing a tennis ball vending machine that can be located at any tennis court.

The present invention also is intended to provide a tennis ball vending machine that will dispense a single can of tennis balls upon receipt of the proper amount of currency.

Furthermore, the present invention is intended to provide a tennis ball vending machine that is rugged in design and construction.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

In accordance with the purpose of the invention, as embodied and broadly described herein, the ball can vending machine of this invention comprises storage means for holding a plurality of cylindrical ball cans with the longitudinal axes of the cans parallel to each other and dispensing means for removing one of the plurality of ball cans from the storage means in response to the occurrence of a predetermined vending condition. Preferably, the dispensing means includes means for receiving currency, and the predetermined vending condition is obtained when the currency-receiving means receives a preselected minimum amount of currency.

In its preferred embodiments, the vending machine of this invention includes a housing adapted to hold a plurality of ball cans with the longitudinal axes of the cans disposed horizontally and a validator adapted to receive currency. The housing includes a forward-facing discharge opening and a rear can-guiding surface, with the rear can-guiding surface sloping downwardly toward the opening. A retaining plate is mounted within the housing above the opening. It slopes downwardly toward the rear can-guiding surface. The preferred embodiments of the invention also include dispensing means for removing one of the ball cans from the housing through the discharge opening in response to the validator receiving a preselected minimum amount of currency.

The accompanying drawings, which are incorporated in and which constitute a part of this specification, illustrate at least one embodiment of the invention and, together with the description, explain the principles of the invention.

DESCRIPTION OF THE PREFERRED EMBODIMENTS

Reference now will be made in detail to the presently preferred embodiments of the invention, examples of which are illustrated in the accompanying drawings.

Figure 2:
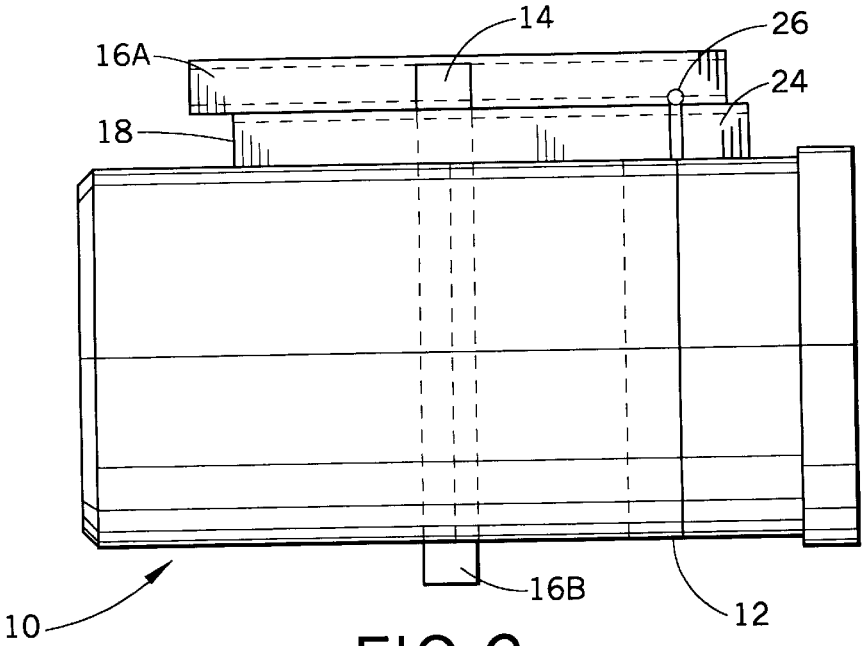
FIG. 2 is a top view of the vending machine shown in FIG. 1.
Figure 1:
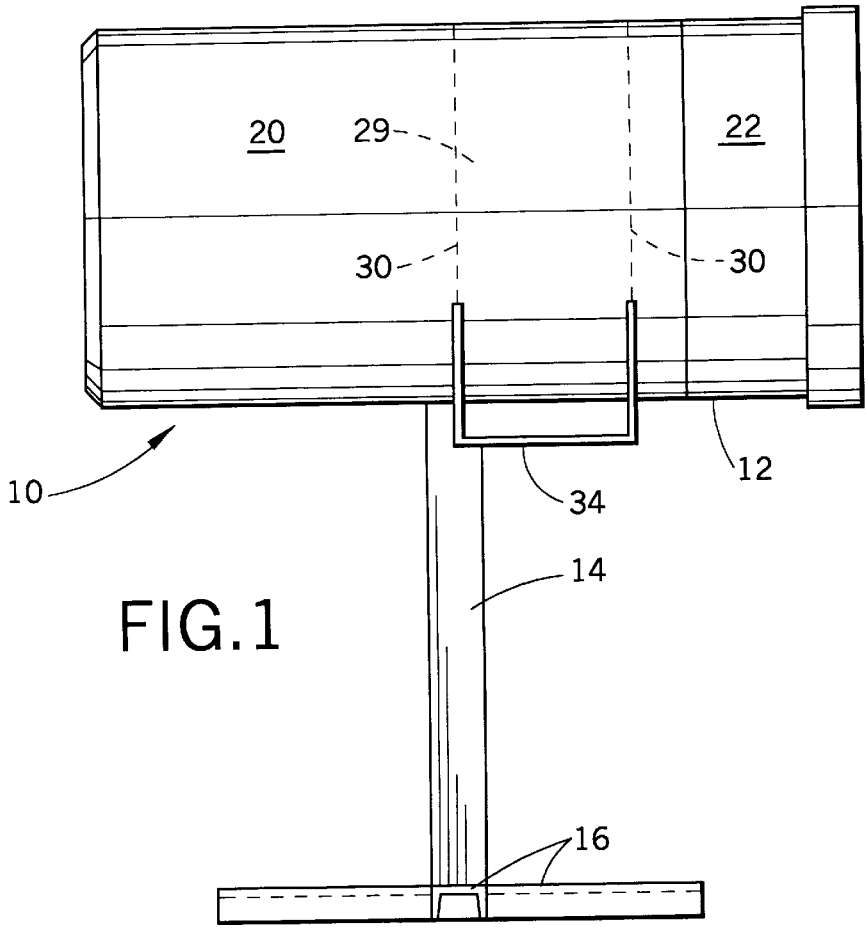
FIG. 1 is a front elevation view of one preferred embodiment of the can ball vending machine of the present invention.
Figure 3:
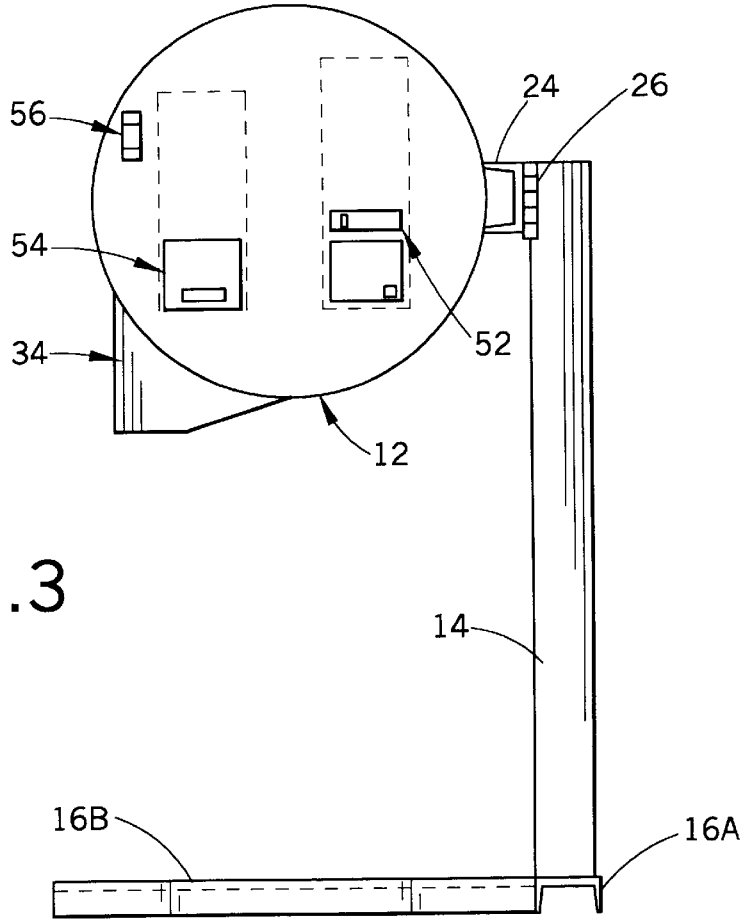
FIG. 3 is a right-side elevation view of the vending machine shown in FIG. 1.

FIGS. 1 through 3 are, respectively, front, top, and side views of one embodiment of the ball can vending machine of the present invention, generally identified by reference numeral 10. Ball can vending machine 10 preferably is intended to dispense cans containing three tennis balls, although it can be adapted to dispense other ball cans, such as cans containing two tennis balls or cans containing two or more racquet balls or paddle tennis balls.

In accordance with the invention, ball can vending machine 10 includes storage means for holding a plurality of ball cans with the longitudinal axes of the cans parallel to each other. In the first embodiment of the invention (see FIGS. 1 through 3), the storage means includes storage drum 12, which preferably is fabricated from 16 gauge steel sheet and is cylindrical in shape, with a circular cross section. The axes of the ball cans are disposed parallel to the cylindrical axis of drum 12. Drum 12 preferably has a diameter approximately 2 feet and can hold up to thirty-six standard tennis ball cans.

Ball can vending machine 10 also includes support means for supporting drum 12 with its cylindrical axis disposed horizontally. In this first embodiment of the invention, the support means includes support pillar 14 and support base 16, the latter being comprised of interconnected channels 16A and 16B. Channels 16A and 16B preferably are steel structural channels connected to each other by welding. The bottom of pillar 14 preferably is welded to channel 16A. As shown in FIG. 2, storage drum 12 is supported on support pillar 14 by main connecting channel 18. Preferably, the legs of channel 18 are welded to the rear side of drum 12, and the web of channel 18 is welded to support pillar 14.

Figure 4:
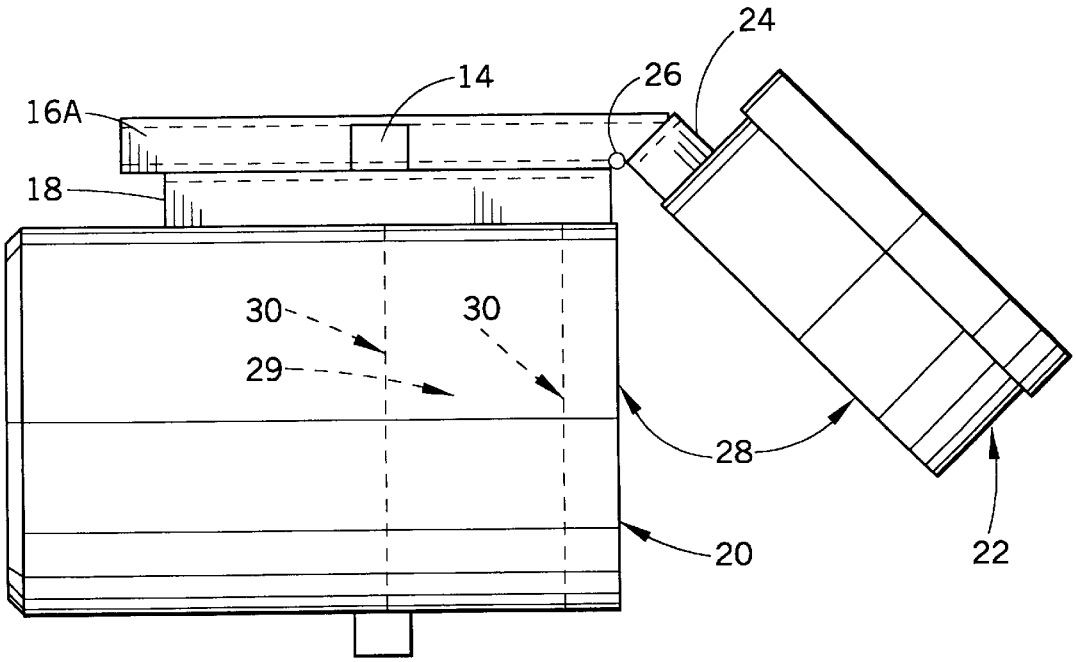
FIG. 4 is a top view of the embodiment of the vending machine shown in FIG. 1, with the end door opened to provide access to the interior of the machine.

As shown in FIG. 4, drum 12 includes a main drum portion 20 and an end door 22 that allows access to the interior of the drum. These two portions of drum 12 are pivotably connected to each other by door connecting channel 24, which is welded to end door 22, and hinge 26, which pivotably connects channel 24 with channel 18. Gaskets 28, preferably made of neoprene, are mounted on the mating edges of main drum portion 20 and end door 22 to provide a water-tight seal between two hinged pieces when end door 22 is closed.

Figure 5:
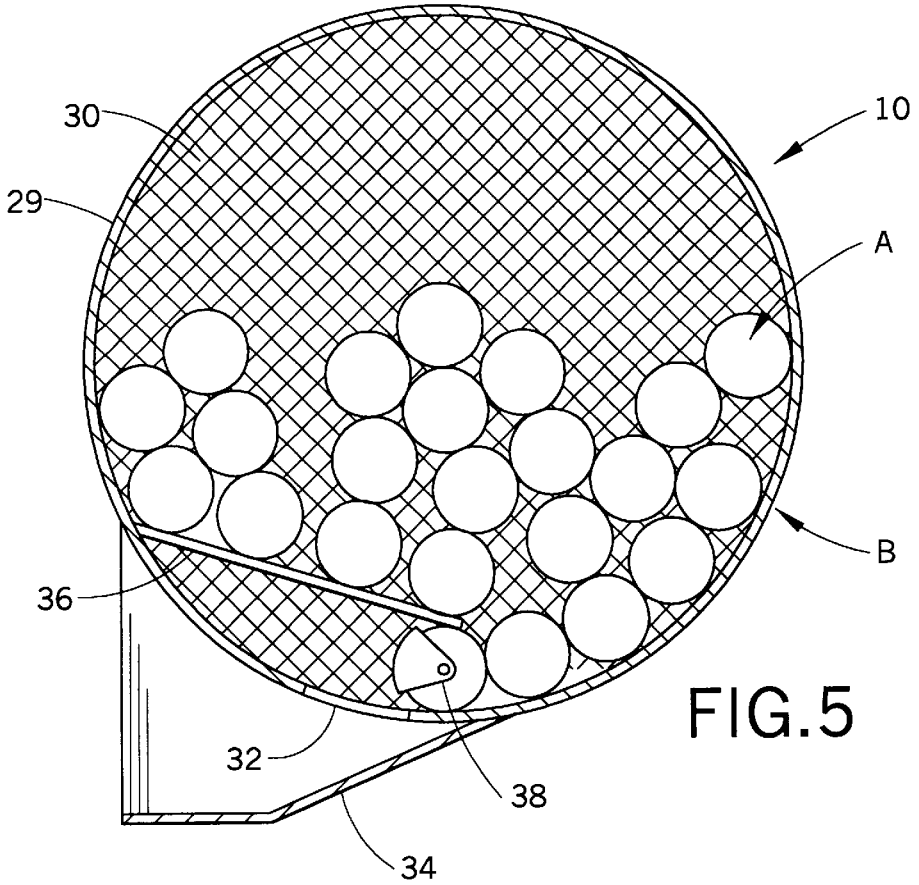
FIG. 5 is a schematic cross-sectional view of the machine shown in FIG. 1, showing a supply of ball cans stored in the machine.

A housing section 29 is defined within main drum portion 20 by dividers 30, which preferably are formed from metal screens and are spaced from one another by a distance slightly greater than the length of the ball can being vended. For a machine designed to vend cans holding three tennis balls, which are about 8 inches long, the spacing between dividers 30 preferably is about 9 inches. The space within main drum portion 20 on the other side of central divider 30 can be used for storage of additional ball cans, or it can be used as another vending section if desired. The divider adjacent end door 22 should be easily removable to provide access to the interior of housing section 29 when end door 22 is open. FIG. 5 shows a plurality of tennis ball cans A held within housing section 29 of vending machine 10.

Figure 6:
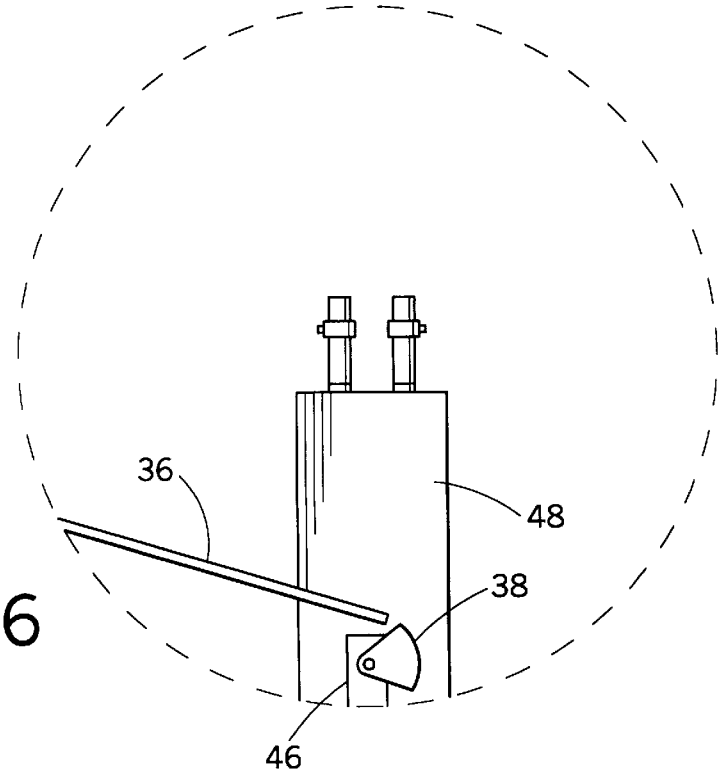
FIG. 6 is a schematic cross-sectional view of the machine shown in FIG. 1, showing the can-dispensing assembly.

Further in accordance with the invention, ball can vending machine 10 includes dispensing means for removing one of the plurality of ball cans from the storage means in response to the occurrence of a predetermined vending condition. As embodied herein and as shown in FIGS. 5 through 7, the dispensing means of the invention includes an discharge opening 32 formed in the wall of main drum portion 20, a dispensing chute 34 welded to portion 20 around opening 32, and retaining plate 40 mounted within housing section 29. Discharge opening 32 preferably is rectangular and sized to allow a single ball can to drop freely out of housing section 29. For the vending of cans containing three tennis balls, the width of the opening (as seen in FIG. 5) is approximately 3½ inches and the length is approximately 9 inches. Retaining plate 36 extends downwardly from the front of housing section 29 and is disposed above discharge opening 32. Retaining plate 36 prevents ball cans A from dropping directly through opening 32. Rather, retaining plate 36 serves as a guide ramp urging cans rearwardly toward the rear can-guiding surface B of housing section 29. The upper end of retaining plate 36 is connected to the front wall of housing section 29 preferably by welding or by fasteners. The lower end of retaining plate 36 preferably is spaced from the wall of housing section 29 by a distance slightly greater than the diameter of the ball can being vended by machine 10.

Figure 7B:
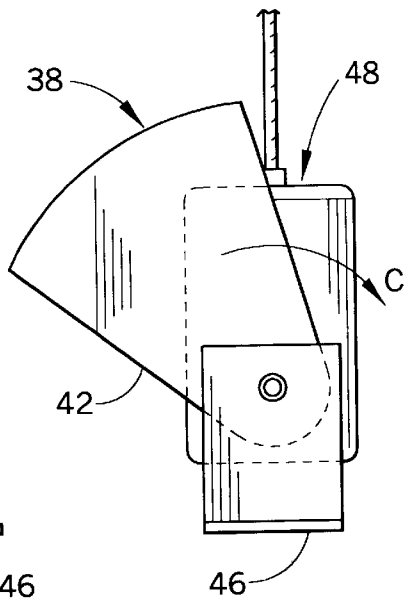
FIGS. 7A and 7B are schematic detail drawings of the can-dispensing assembly of the embodiment of the invention shown in FIG. 1.
Figure 7A:
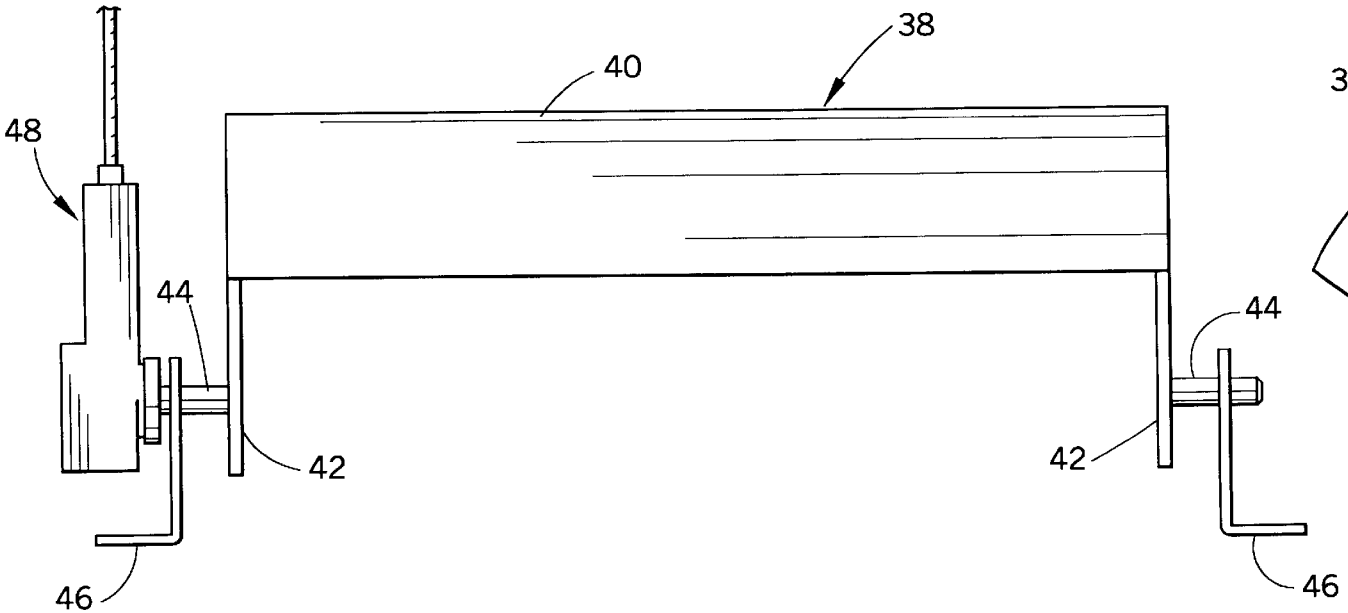

The dispensing means of the invention for this first embodiment also includes selector arm 38, which is pivotably mounted within housing section 29 adjacent discharge opening 32. As shown in FIG. 7A, selector arm 38 includes dispensing plate 40 and a pair of legs 42, one at each end of plate 40. An axle 44 extends outwardly from each leg 42. Dispensing plate 40 preferably is curved with a radius slightly larger than the radius of the ball cans being vended, as best seen in FIG. 5. With reference to FIGS. 7A and 7B, axles 44 are rotationally supported by support brackets 46, which are mounted on the inner surface of main drum portion 20 on each side of housing section 29. Dividers 30 (see FIG. 1) preferably are in line with legs 42 to maintain ball cans A in alignment with selector arm 38. Accordingly, dividers 30 should be cut out at their bottom edges to provide clearance for selector arm 38.

The dispensing means also includes electrically powered actuator 48, which is connected to one of axles 44. Actuator 48 preferably has a spring return and is shown in its normal, spring-returned position in FIGS. 5 and 7B. In this position, the lowermost ball can along rear can-guiding surface B is urged by gravity and the interaction of the other cans within housing section 29 to nest within dispensing plate 40. Preferably, dispensing plate 40 covers about 55–60 degrees of the circumference of a nested ball can and is rotated about 7–8 degrees from vertical in this first position, so that the clearance between the lower edge of dispensing plate 40 and the wall of housing section 29 is too small to permit passage of the ball can to discharge opening 32. When actuator 48 is activated, however, it rotates selector arm 38 clockwise (see arrow C in FIG. 7B and the position of arm 38 in FIG. 6), freeing the formerly nested ball can to roll forward to the adjacent discharge opening, where it falls out of housing section 29 and into chute 34. While selector arm 38 is in the actuated position shown in FIG. 6, it prevents the next ball can in line along rear can-guiding surface B from moving further. Actuator 48 is energized only momentarily, for about 5 seconds. Selector arm 38 then pivots back to the position shown in FIGS. 5 and 7A by operation of the spring-return feature, and the next ball can along rear can-guiding surface B moves into a position nested within dispensing plate 40.

Actuator 48 preferably is of the type used to control or modulate dampers for HVAC systems, such as the BELIMO direct coupled damper actuator Model No. NM24. The actuator should be set to rotate selector arm 38 through a total angle of about 15–16 degrees.

Further in accordance with the invention, ball can vending machine 10 includes means for receiving currency and producing an output signal upon receiving a preselected minimum amount of currency. The word "currency" as used in this application includes tokens, tickets, and other means of exchange in addition to coins and paper bills. As embodied herein and as shown schematically in FIG. 3, the currency receiving means of the invention includes a coin validator 52 and a bill validator 54 of conventional design intended for operation outdoors, preferably with the ability to make change for the selling price of a single can of balls. Examples of validators that can be utilized with the vending machine of this invention are the Mars Electronics Model No. TRC-6800 coin changer and the Mars Electronics Model No. VFM1/VFM3 bill validator.

Validators 52 and 54 preferably are mounted within end door 22, and access to currency collection is provided when end door 22 is opened. End door 22 preferably is secured to main drum portion 20 by barrel lock 56 of rugged design (preferably formed from stainless steel) to ensure against easy access to the money collected by the validators. The validators and actuator 48 preferably operate with standard 120 volt AC current supplied by via a cable (not shown) that runs through support pillar 14.

Figure 8:
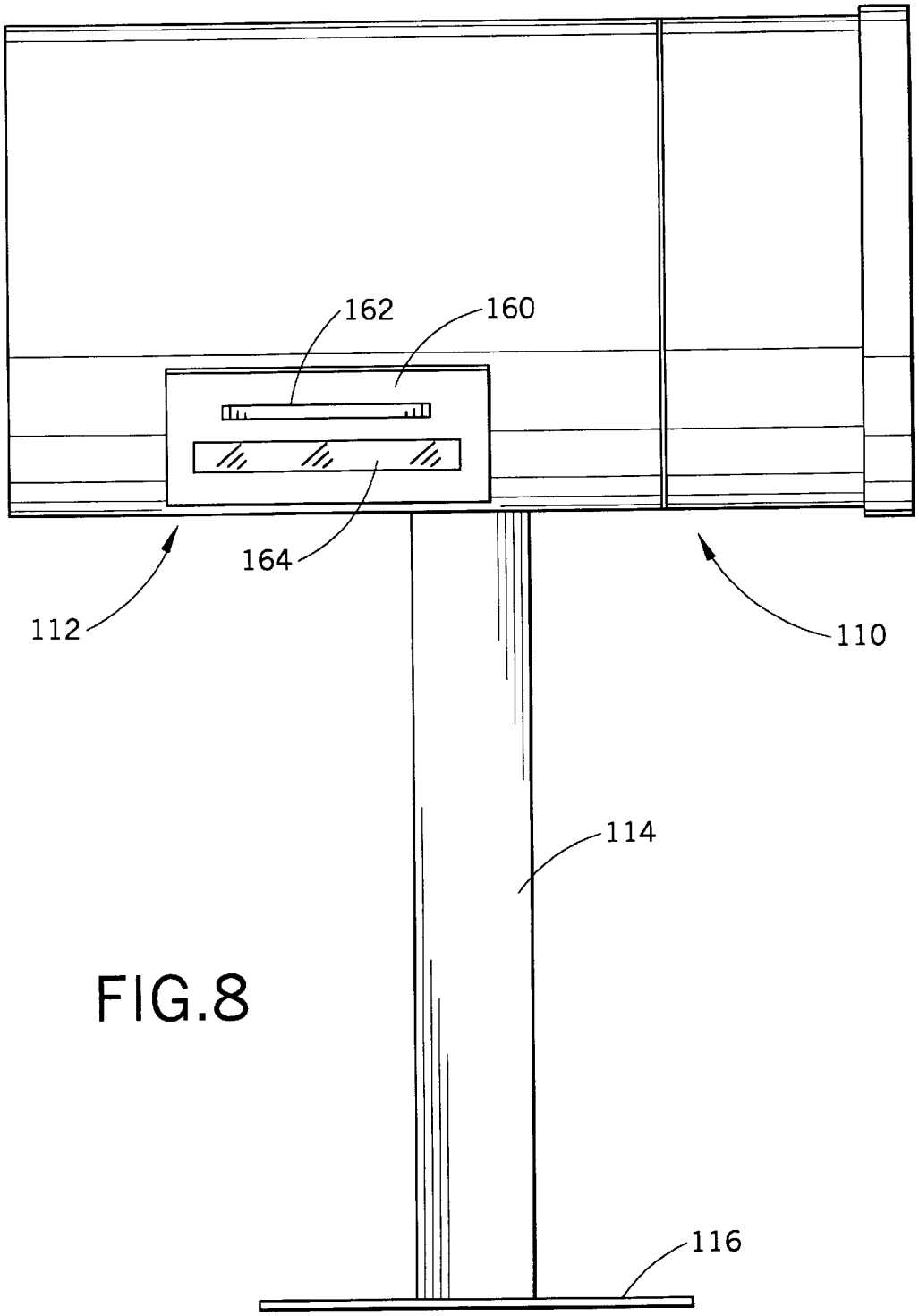
FIG. 8 is a front elevation view of a second preferred embodiment of the can ball vending machine of the present invention.
Figure 9:
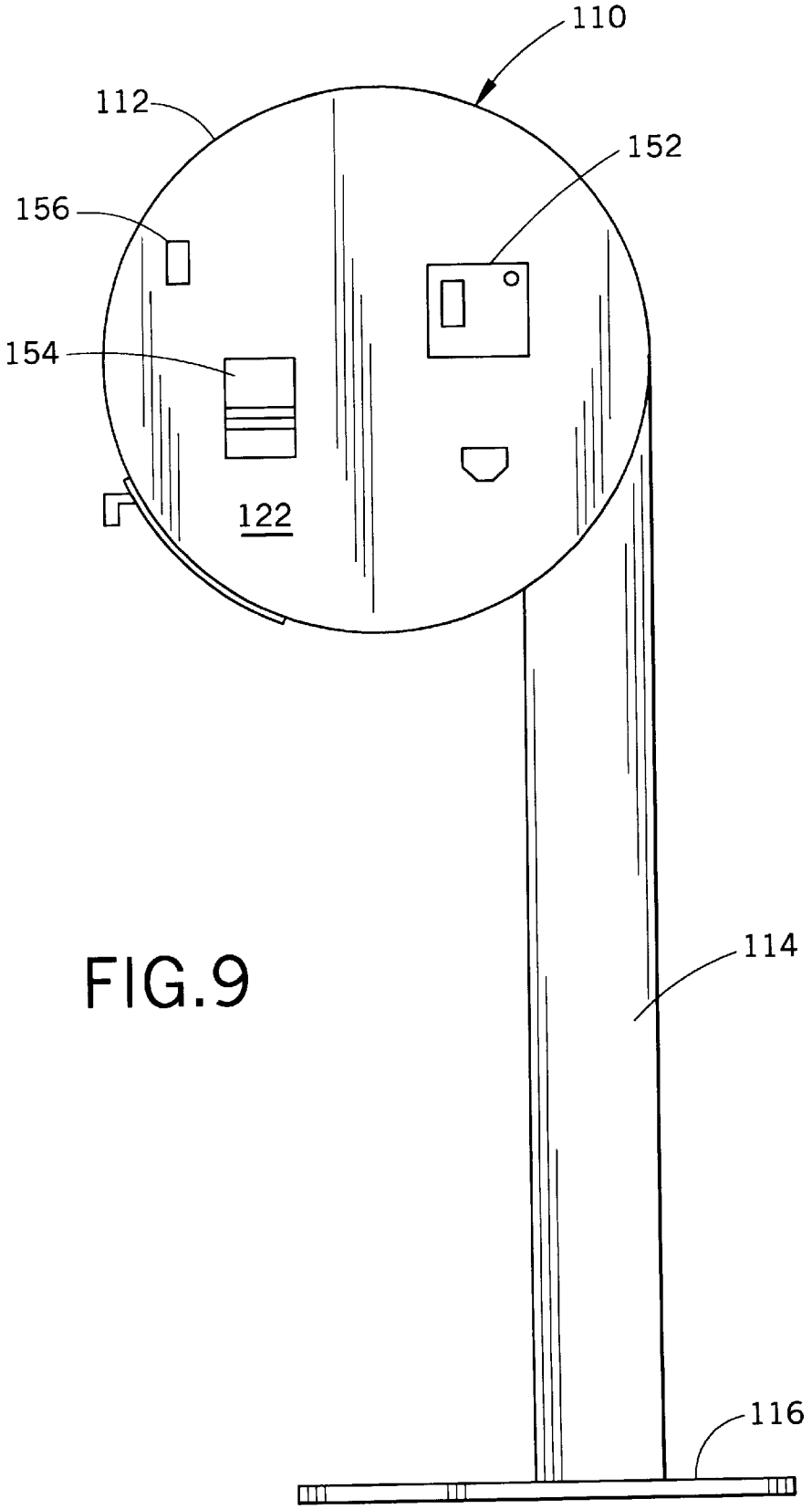
FIG. 9 is a right-side elevation view of the vending machine shown in FIG. 8.
Figure 10:
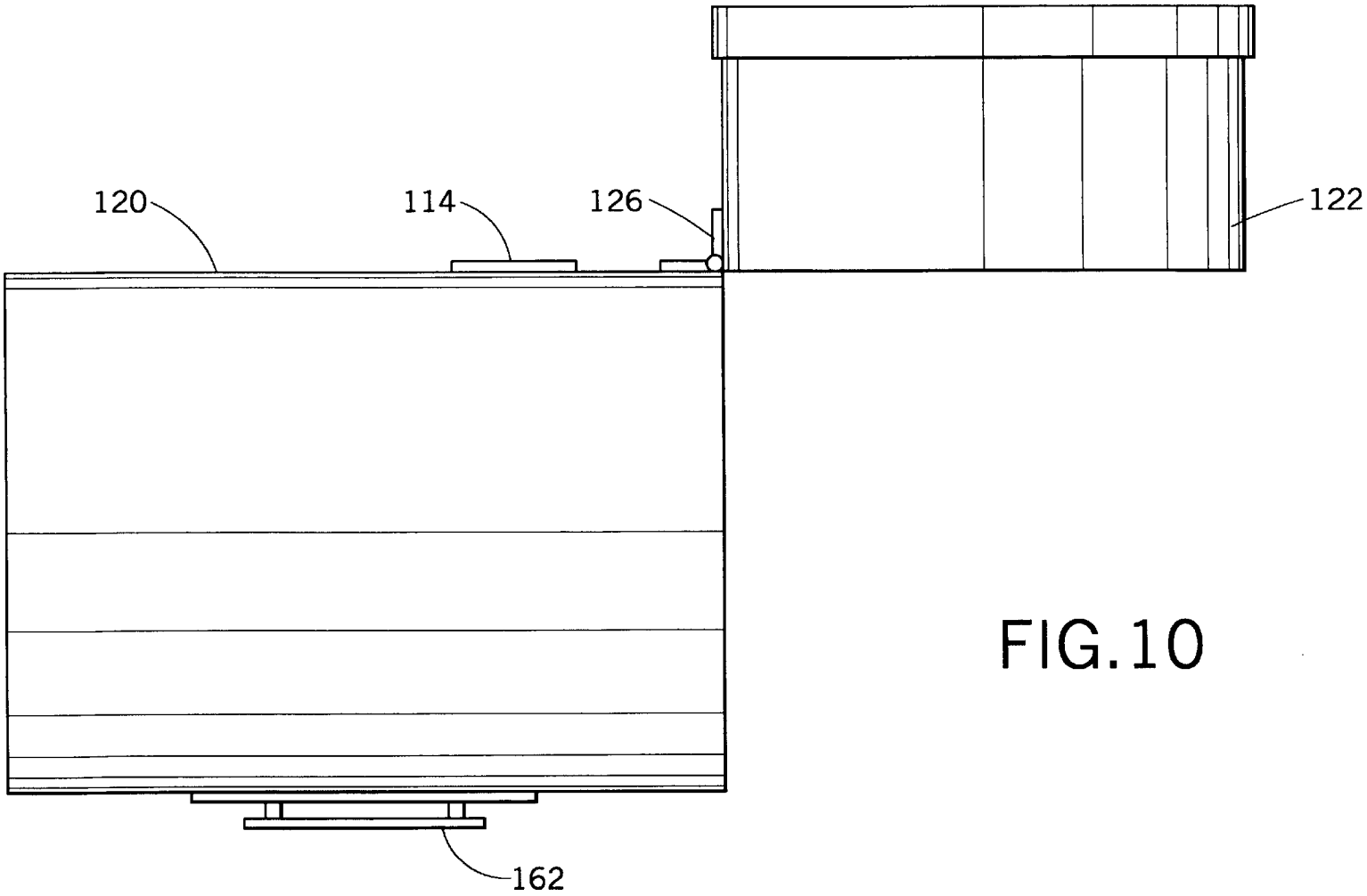
FIG. 10 is a top view of the embodiment of the vending machine shown in FIG. 8, with the end door opened to provide access to the interior of the machine.

A second embodiment of the ball can vending machine of this invention, designated generally by reference numeral 110, is shown in FIGS. 8 through 12. FIGS. 8 and 9 show respectively front and side elevations of machine 110, which includes cylindrical storage drum 112 mounted with its axis disposed horizontally on support column 114, which in turn is connected to support base 116. As shown in FIG. 10, storage drum 112 includes main drum portion 120 and end door 122. Drum portion 120 preferably is welded to the top of support column 114, with end door 122 being pivotably connected to drum portion 120 by hinge plate 126. Mounted on end door 122 are coin validator 152, bill validator 154, and barrel lock 156, which operate in the same manner as validators 52, 54 and lock 56 described above with reference to the first embodiment of the invention.

Figure 11:
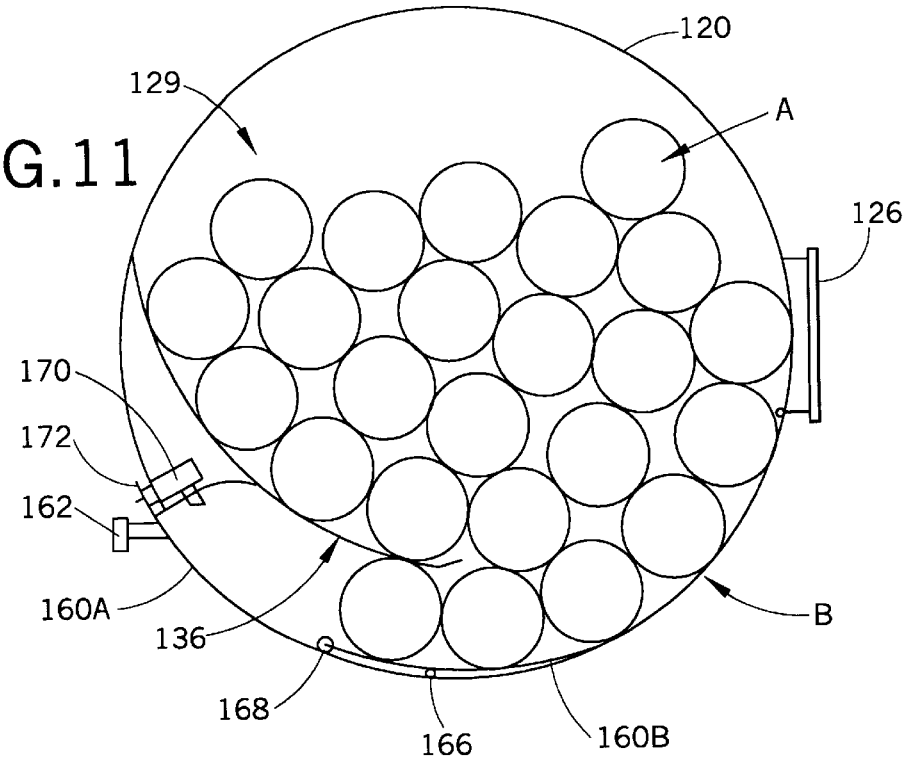
FIG. 11 is a schematic cross-sectional view of the machine shown in FIG. 8, with the access door closed.
Figure 12:
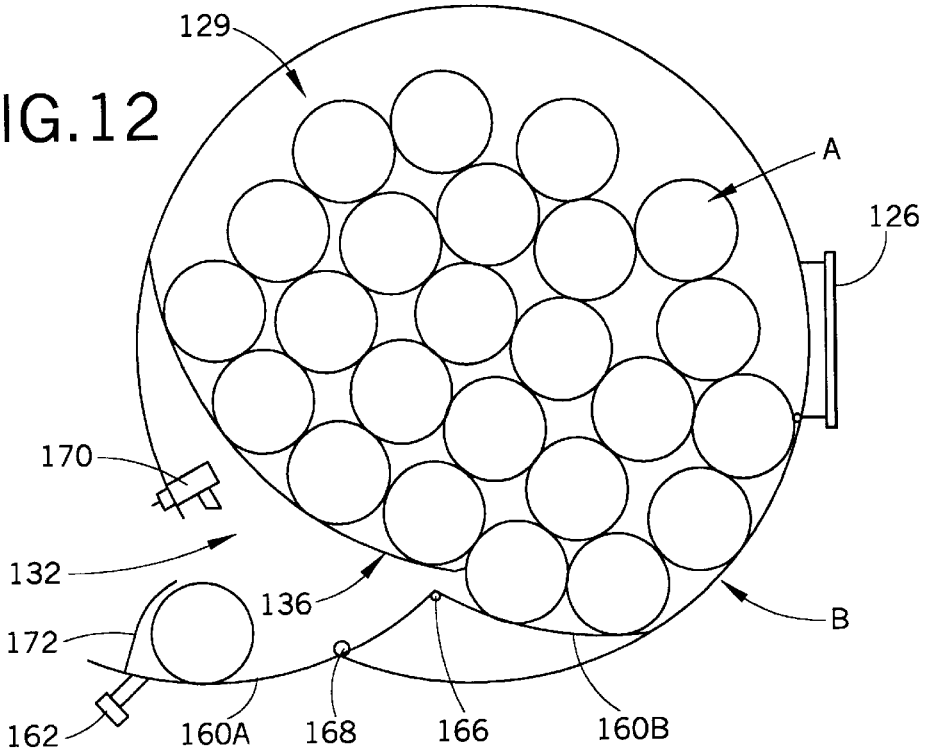
FIG. 12 is a schematic cross-sectional view of the machine shown in FIG. 8, showing a supply of ball cans stored in the machine with the access door opened.
Figure 13:
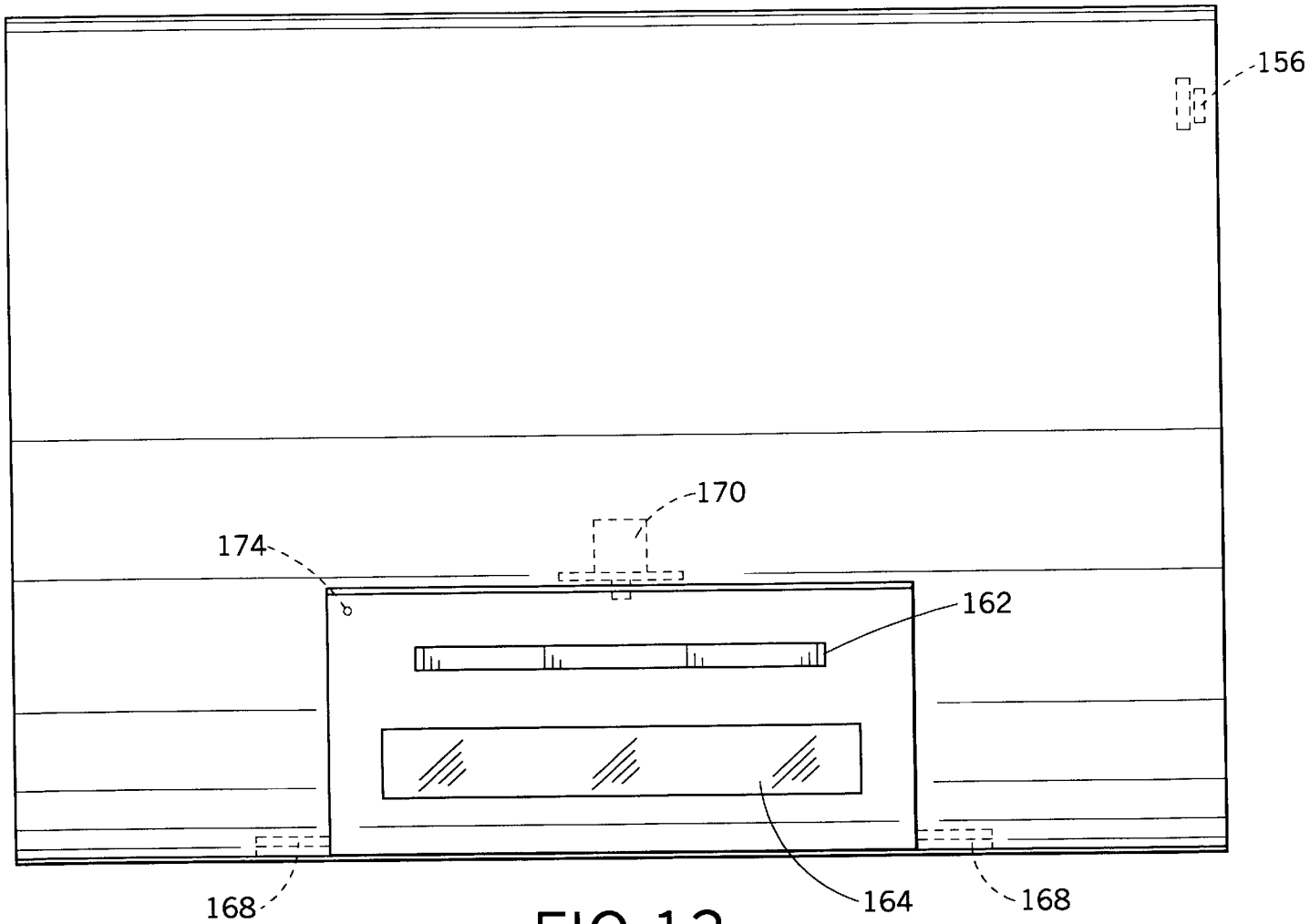
FIG. 13 is a schematic detail view of the access door of the embodiment of the present invention shown in FIG. 8.

The second embodiment of the present invention includes a cylindrical housing section 129 within main drum portion 120. A discharge opening 132 is provided in the front, lower portion of housing section 129 (see FIG. 12). An access door 160 is pivotably connected to drum portion 120 and covers discharge opening 132. FIGS. 11 and 12 show the interior of housing section 129 with door 160 in its closed and open positions, respectively. Door 160 includes a handle 162 and a transparent window 164. Window 164, preferably made of plexiglass, allows one to determine whether a ball can is in position for vending.

As seen in FIGS. 11 and 12, vending machine 110 includes retaining plate 136 disposed within housing section 129 above discharge opening 132. Retaining plate 136 has an upper end connected to the front wall of housing section 129 and slopes downwardly to a lower end that is spaced from the wall of housing section 129 by a distance slightly greater than the diameter of the ball cans being vended. Preferably, retaining plate 136 is curved such that the spacing between the retaining plate and the outer wall of housing section 129 varies from a minimum at the upper end of retaining plate 136 to a maximum at the lower end. This can be accomplished by providing retaining plate 136 with a constant radius of curvature approximately equal to the radius of curvature of housing section 129. Retaining plate 136 prevents ball cans A from dropping directly through opening 132 and serves as a guide ramp urging cans rearwardly toward the rear can-guiding surface B of housing section 129.

Access door 160 includes upper door portion 160A and lower door portion 160B, with portions 160A and 160B being pivotably connected by hinge 166. Upper door portion 160A is pivotably connected to main drum portion 120 by axles 168, which are supported by bushings (not shown). Preferably, the spacing between retaining plate 136 and the outer wall of housing section 129 is such that, when door 160 is closed, gravity and interaction between the ball cans will urge the lowermost ball can into a position adjacent axles 168, as shown in FIG. 11.

Door 160 is locked in its closed position by solenoid-actuated latch 170. When currency validators 152, 154 receive currency sufficient to meet the selling price of a can of balls, they cause energization of latch 170, unlocking door 160.

When door 160 is unlocked, the person buying the ball can grabs the handle 162 and lowers upper door portion 160A. This action causes door portion 160A to pivot about axles 168 to the open position shown in FIG. 12. The lowermost ball can rolls along lowered door portion 160A and is stopped by can stop 172. As upper door portion 160A is being lowered, the hinged connection between portions 160A and 160B is displaced upwardly toward retaining plate 136, preventing access by additional cans to opening 132. Thus, only a single can will be dispensed when the door is opened.

Door 160 preferably is spring loaded and returns automatically to its closed position after the vended ball can is removed and handle 162 is released. The next ball can then moves into position adjacent axles 168, and latch 170 locks the door in its closed position. To assist in preventing the removal of more than one ball can at a time, a door switch 174 is provided in one upper corner of discharge opening 132. When door 160 is opened, the door switch actuates the solenoid circuit to return the striker of latch 170 in its locked position. Thus, when the door returns to its closed position by the door spring (not shown), latch 170 automatically locks the door in its closed position.

It will be apparent to those skilled in the art that other modifications and variations can be made in the invention without departing from the scope of the invention. The invention in its broader aspects is, therefore, not limited to the specific details and illustrated examples shown and described. Accordingly, it is intended that the present invention cover such modifications and variations provided that they fall within the scope of the appended claims and their equivalents.

I claim:

1. A ball can vending machine, comprising:

a housing adapted to hold a plurality of ball cans with the longitudinal axes of the cans disposed horizontally, said housing including a forward-facing discharge opening and a rear can-guiding surface, said rear can-guiding surface sloping downwardly toward said discharge opening;

a retaining plate mounted within said housing and disposed above said discharge opening, said retaining plate sloping downwardly toward said rear can-guiding surface, said retaining plate having an upper end connected to a wall of said housing section and a lower end spaced above said wall of said housing by a distance slightly larger than the diameter of a ball can;

a validator adapted to receive currency; and dispensing means for removing one of the ball cans from said housing through said discharge opening in response to said validator receiving a preselected amount of currency.

2. The machine of claim 1, wherein said validator produces an output signal upon receiving said preselected amount of currency, and said dispensing means is responsive to said output signal from said validator.

3. The machine of claim 2, wherein said dispensing means includes:

a selector arm adjacent said discharge opening, said selector arm being pivotable between a first position and a second position; and an actuator connected to said selector arm and responsive to said validator, said actuator pivoting said selector arm from said first position to said second position in response to said output signal from said validator.

4. The machine of claim 3, wherein said selector arm includes a dispensing plate adapted to hold a ball can in a nesting relationship when said selector arm is in said first position.

5. The machine of claim 4, wherein movement of said selector arm from said first position to said second position permits the nested ball can to move under the influence of gravity to said discharge opening.

6. The machine of claim 3, wherein, upon receipt of said output signal, said actuator moves said selector arm to said second position momentarily and then returns said selector arm to said first position.

7. The machine of claim 6, wherein said actuator moves said selector arm to said second position for approximately five seconds before returning said selector arm to said first position.

8. The machine of claim 2, wherein said dispensing means includes:

an access door disposed over said discharge opening and pivotably connected to said housing between a closed position and an open position; and latch means responsive to said validator for selectively locking and unlocking said access door in the closed position, said latch means unlocking said access door in response to receiving said output signal from said validator.

9. A ball can vending machine, comprising:

a housing adapted to hold a plurality of ball cans with the longitudinal axes of the cans disposed horizontally said housing including a forward-facing discharge opening and a rear can-guiding surface, said rear can-guiding surface sloping downwardly toward said discharge opening, a retaining plate mounted within said housing and disposed above said discharge opening, said retaining plate sloping downwardly toward said rear can-guiding surface, said retaining plate having an upper end connected to a wall of said housing section and a lower end spaced above said wall of said housing by a distance slightly larger than the diameter of a ball can, a validator adapted to receive currency said validator producing an output signal upon receiving a preselected amount of currency; and dispensing means responsive to said output signal from said validator for removing one of the ball cans from said housing through said discharge opening in response to said validator receiving said preselected amount of currency said dispensing means including:

an access door disposed over said discharge opening and pivotably connected to said housing between a closed position and an open position; and latch means responsive to said validator for selectively locking and unlocking said access door in the closed position said latch means unlocking said access door in response to receiving said output signal from said validator.

10. The machine of claim 9, wherein said retaining plate is curved such that the spacing between said retaining plate and said wall of said housing varies from a minimum at said upper end of said retaining plate to a maximum at said lower end of said retaining plate.

11. The machine of claim 10, wherein said housing is cylindrical with a circular cross section, and said retaining plate has a constant radius of curvature approximately equal to the radius of curvature of said housing.

12. The machine of claim 9, wherein said access door includes an upper door portion, a lower door portion, and a hinge pivotably connecting said upper and lower door portions, said upper door portion being pivotably connected to said housing such that pivoting said access door to said open position decreases the spacing between said hinge and said retaining plate.

13. The machine of claim 12, wherein said housing is cylindrical with a circular cross section, and said upper and lower door portions have a radius of curvature approximately equal to the radius of curvature of said housing.

14. A ball can vending machine, comprising:

a storage drum including a cylindrical housing section of circular cross section, said housing section being sized to hold a plurality of ball cans with the longitudinal axes of the cans disposed parallel to the cylindrical axis of the housing section, said housing section including a forward-facing discharge opening and a rear can-guiding surface;

support means for supporting said storage drum with said axis of said housing section disposed horizontally;

a retaining plate mounted within said housing section and disposed above said discharge opening, said retaining plate sloping downwardly toward said rear can-guiding surface, said retaining plate having an upper end connected to said outer wall of said housing section and a lower end spaced above said outer wall of said housing section by a distance slightly larger than the diameter of a ball can;

a validator adapted to receive currency, said validator producing an output signal upon receiving a preselected amount of currency; and a can dispenser disposed adjacent said discharge opening such that cans within said housing section are urged by gravity toward said can dispenser along said rear-can-guiding surface, said can dispenser including:

a selector arm pivotable between a first position and a second position, and an actuator connected to said selector arm and responsive to said validator, said actuator pivoting said selector arm from said first position to said second position in response to said output signal from said validator.

15. The machine of claim 14, wherein said selector arm includes a dispensing plate adapted to hold a ball can in a nesting relationship when said selector arm is in said first position.

16. The machine of claim 15, wherein movement of said selector arm from said first position to said second position permits the nested ball can to move under the influence of gravity to said discharge opening.

17. The machine of claim 16, wherein, upon receipt of said output signal, said actuator moves said selector arm to said second position momentarily and then returns said selector arm to said first position.

18. The machine of claim 17, wherein said actuator moves said selector arm to said second position for approximately five seconds before returning said selector arm to said first position.

19. A ball can vending machine, comprising:

a storage drum including a cylindrical housing section having an outer wall of circular cross section, said housing section being sized to hold a plurality of ball cans with the longitudinal axes of the cans disposed parallel to the cylindrical axis of the housing section, said housing including a forward-facing discharge opening and a rear can-guiding surface;

support means for supporting said storage drum with said axis of said housing section disposed horizontally;

a retaining plate mounted within said housing section and disposed above said discharge opening, said retaining plate sloping downwardly toward said rear can-guiding surface, said retaining plate having an upper end connected to said outer wall of said housing section and a lower end spaced above said outer wall of said housing section by a distance slightly larger than the diameter of a ball can;

an access door disposed over said opening of said housing section and pivotably connected to said housing section between a closed position and an open position;

a validator adapted to receive currency, said validator producing an output signal upon receiving a preselected amount of currency; and latch means responsive to said validator for selectively locking and unlocking said access door in the closed position, said latch means unlocking said access door in response to receiving said output signal from said validator.

20. The machine of claim 19, wherein said retaining plate is curved as viewed along the longitudinal axis of said housing section such that the spacing between said retaining plate and said outer wall of said housing section varies from a minimum at said upper end of said retaining plate to a maximum at said lower end of said retaining plate.

21. The machine of claim 20, wherein said retaining plate has a constant radius of curvature approximately equal to the radius of curvature of said housing section.

22. A ball can vending machine, comprising:

a storage drum including a cylindrical housing section having an outer wall of circular cross section, said housing section being sized to hold a plurality of ball cans with the longitudinal axes of the cans disposed parallel to the cylindrical axis of the housing section, said housing including a forward-facing discharge opening and a rear can-guiding surface;

support means for supporting said storage drum with said axis of said housing section disposed horizontally;

a retaining plate mounted within said housing section and disposed above said discharge opening, said retaining plate sloping downwardly toward said rear can-guiding surface;

an access door disposed over said opening of said housing section and pivotably connected to said housing section between a closed position and an open position, said access door including an upper door portion, a lower door portion, and a hinge pivotably connecting said upper and lower door portions, said upper door portion being pivotably connected to said housing section such that pivoting said access door to said open position decreases the spacing between said hinge and said retaining plate, a validator adapted to receive currency, said validator producing an output signal upon receiving a preselected amount of currency; and latch means responsive to said validator for selectively locking and unlocking said access door in the closed position, said latch means unlocking said access door in response to receiving said output signal from said validator.

23. The machine of claim 22, wherein said upper and lower door portions have a radius of curvature approximately equal to the radius of curvature of said housing section.

* * * * *